US006133879A

United States Patent [19]

Grangeat et al.

[11] Patent Number: 6,133,879

[45] Date of Patent: Oct. 17, 2000

[54] MULTIFREQUENCY MICROSTRIP ANTENNA AND A DEVICE INCLUDING SAID ANTENNA

[75] Inventors: Christophe Grangeat, Sevres; Charles Ngounou, Les Ulis; Jean-Philippe Coupez, Brest; François Lepennec, Porspoder; Serge Toutain, Plouzanne, all of France

[73] Assignee: Alcatel, Paris, France

[21] Appl. No.: 09/209,447

[22] Filed: Dec. 11, 1998

[30] Foreign Application Priority Data

Dec. 11, 1997 [FR] France ..... 97 15693

[51] Int. Cl.[7] ..... H01Q 1/38

[52] U.S. Cl. ..... 343/700 MS

[58] Field of Search ..... 345/700 MS; H01Q 1/38

[56] References Cited

U.S. PATENT DOCUMENTS 4,320,401 3/1982 Schianvone ..... 343/700 MS

FOREIGN PATENT DOCUMENTS 0 493 014 A1 7/1992 European Pat. Off. .

0 749 176 A1 12/1996 European Pat. Off. .

0 795 926 A2 9/1997 European Pat. Off. .

OTHER PUBLICATIONS

T. D. Ormiston et al, "Microstrip Short–Circuit Patch Design Equations", Microwave and Optical Technology Letters, vol. 16, No. 1, Sep. 1997, pp. 12–14.

S. Mellah et al, "Novel Microstrip Circular Patch Antennas", 24$^{th}$ European Microwave Conference Proceedings, Cannes, Sep. 5–8, 1994, vol. 2, No. Conf. 24, Sep. 5, 1994, pp. 1750–1755, European Microwave Management Committee.

*Primary Examiner*—Michael C. Wimer

*Attorney, Agent, or Firm*—Sughrue, Mion, Zinn, Macpeak & Seas, PLLC

[57] ABSTRACT

A multifrequency microstrip antenna in accordance with the present invention includes two zones connected to a short-circuit consisting of two conductive strips. These zones are sufficiently decoupled from each other to enable two resonances to be established in two respective different areas formed by the zones. The resonances are at least approximately of the quarter-wave type and each has an electric field node fixed by the short-circuit. The same coupling device is used to excite the two resonances. The invention applies in particular to portable telephones and to their base stations.

10 Claims, 3 Drawing Sheets

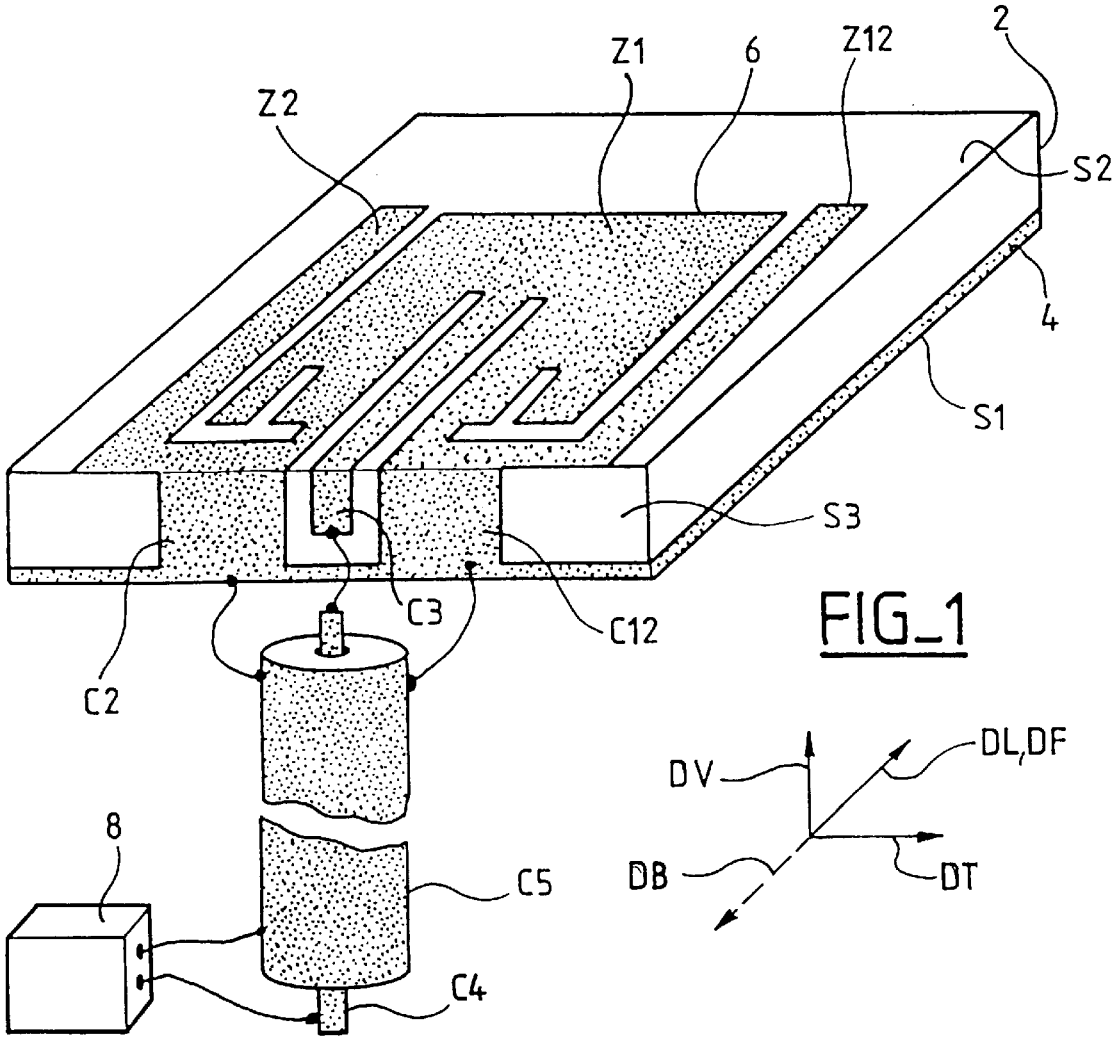
FIG_1
FIG_4
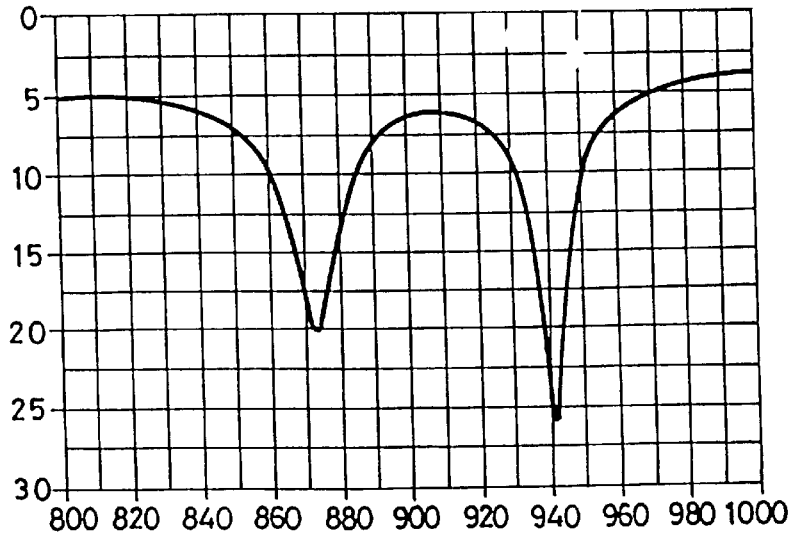

MULTIFREQUENCY MICROSTRIP ANTENNA AND A DEVICE INCLUDING SAID ANTENNA

The present invention concerns microstrip antennas. An antenna of the above kind includes a patch that is typically obtained by etching a metallic layer. It is known as a microstrip patch antenna.

BACKGROUND OF THE INVENTION

The microstrip technique is a planar technique with applications to making signal transmission lines and to making antennas constituting a coupling between such lines and radiated waves. It employs conductive patches and/or strips formed on the top surface of a thin dielectric substrate which separates them from a conductive ground layer on the bottom surface of the substrate. A patch of the above kind is typically wider than a strip of the above kind and its shape and dimensions constitute important characteristics of the antenna. The substrate is typically in the form of a rectangular plane sheet of constant thickness. This is in no way obligatory, however. In particular, it is known that an exponential variation in the thickness of the substrate widens the bandwidth of an antenna of the above kind and that the shape of the sheet can depart from the rectangular shape. The electric field lines extend through the substrate between the strip or the patch and the ground layer. The above technique differs from various other techniques that also use conductive elements on a thin substrate, namely:

- the stripline technique in which a strip is confined between the bottom ground layer and a top ground layer which in the case of an antenna must include a slot to enable coupling with the radiated waves,
- slotted line techniques in which the electric field is established between two parts of a conductive layer formed on the top surface of the substrate and separated from each other by a slot which in the case of an antenna must typically open into a wider opening facilitating coupling with the radiated waves, for example by forming a resonant structure, and
- the coplanar line technique in which the electric field is established on the top surface of the substrate and symmetrically between a central conductive strip and two conductive areas on respective opposite sides of the strip from which they are separated by respective slots. In the case of an antenna, the strip is typically connected to a wider patch to form a resonant structure providing a coupling with the radiated waves.

With regard to the manufacture of antennas, the following description will on occasion and for simplicity be restricted to the case of a transmit antenna connected to a transmitter. It must nevertheless be understood that the arrangements described could equally apply to receive antennas connected to a receiver. With the same aim of simplicity it will be assumed that the substrate is in the form of a horizontal sheet.

Broadly speaking, a distinction can be made between two fundamental types of resonant structure that can be implemented in microstrip technology. The first type might be called a "half-wave" structure. The antenna is then a "half-wave" or "electric" antenna. Assuming that one dimension of the patch constitutes a length and extends in a longitudinal direction, the length is substantially equal to half the wavelength of an electromagnetic wave propagating in that direction in the line consisted by the ground plane, the substrate, and the patch. Coupling with the radiated waves occurs at the ends of the length, the ends being in regions where the amplitude of the electric field in the substrate is maximal.

A second type of resonant structure that can be implemented using the same technology might be called a "quarter-wave" structure. The antenna is then a "quarter-wave" or "magnetic" antenna. It differs from a half-wave antenna firstly in that its patch has a length substantially equal to one fourth of the wavelength, with the length of the patch and the wavelength being defined as above, and secondly in that there is a hard short-circuit at one end of the length between the ground plane and the patch so as to impose a quarter-wave type resonance with a node of the electric field fixed by the short-circuit. The coupling with the radiated waves occurs at the other end of the length, which is in the region in which the amplitude of the electric field through the substrate is maximal.

In practice various types of resonance can occur in such antennas. They depend in particular on:

- the configuration of the patches, which can include slots, possibly radiating slots,
- the presence and the location of any short-circuits and of electrical models representative of short-circuits, although the latter cannot always be deemed to be equivalent, even approximately, to perfect short-circuits of zero impedance, and
- coupling devices included in such antennas for coupling their resonant structures to a signal processing unit such as a transmitter, and the location of such devices.

For a given antenna configuration there may be more than one resonant mode enabling use of the antenna at a plurality of frequencies corresponding to the resonant modes.

An antenna of the above kind is typically coupled to a signal processing unit such as a transmitter not only by means of a coupling device included in the antenna but also by means of a connecting line external to the antenna and connecting the coupling device to The signal processing unit. Considering an overall functional system including the signal processing unit, the connecting line, the coupling device, and the resonant structure, the coupling device and the connecting line must be made so that the system has a uniform impedance throughout its length, which avoids spurious reflections opposing good coupling.

In the case of a transmit antenna having a resonant structure, the respective functions of the coupling device, of the connecting line, and of the antenna are as follows: the function of the connecting line is to transport a radio frequency or microwave frequency signal from the transmitter to the terminals of the antenna. All along a line of the above kind the signal propagates in the form of a traveling wave without any significant modification of its characteristics, at least in theory. The function of the coupling device is to convert the signal supplied by the connecting line to a form in which it can excite resonance of the antenna, i.e. the energy of the traveling wave carrying the signal must be transferred to a standing wave established in the antenna with characteristics defined by the antenna. As for the antenna, it transfers energy from the standing wave to a wave that is radiated into space. The signal supplied by the transmitter is therefore converted a first time from the form of a traveling wave to that of a standing wave and then a second time to the form of a radiated wave. In the case of a receive antenna the signal takes the same forms in the same units but the conversions are carried out in the opposite direction and in the reverse order.

The connecting lines can be implemented in a nonplanar technology, for example in the form of coaxial lines.

Planar technology antennas are used in various types of equipment. They include mobile telephones, base stations for mobile telephones, automobiles, aircraft, and missiles. In the case of a mobile telephone, the continuous nature of the bottom ground layer of the antenna means that the radiated power intercepted by the body of the user of the device is easily limited. In the case of automobiles, and above all in the case of an aircraft or a missile whose outside surface is a metal surface and has a curved profile to minimize drag, the antenna can be conformed to that profile so as not to generate any unwanted additional drag.

European patent application EP 0 749 176 describes a microstrip antenna including:

a plane dielectric substrate;

a conductor constituting a ground plane on the bottom surface of said substrate;

three conductive areas on the top surface of the substrate each having an elongate shape imparting to the antenna a double-C or three-branch candlestick shape;

an antenna coupling device common to all the conductive areas.

The area in the middle of the candlestick has an electric field node fixed by a series of short-circuits to the ground plane, the series of short-circuits being disposed all along the axis of symmetry of this area.

The conductive areas are separated from each other by relatively wide slots (0.7 cm wide for a wavelength of 3.3 cm) so that an antenna of this kind can be smaller than a prior art antenna for a given wavelength. However, the antenna is not able to operate properly at more than one frequency, for example in a multiband mobile telephone.

The present invention is more particularly concerned with the situation in which an antenna of the above kind must have the following properties:

it must be a multifrequency antenna, i.e. it must be able to transmit and/or to receive efficiently on more than one operating frequency, it must be possible to connect it to a single processing unit by means of a single connecting line for all operating frequencies, and to achieve this it must not be necessary to use a frequency multiplexer or demultiplexer.

Various prior art microstrip antennas have the above properties. They will now be discussed:

A first prior art antenna is described in patent document U.S. Pat. No. 4,766,440 (Gegan). The patch 10 of that antenna has a continuous curved U-shape slot entirely within the patch. The slot radiates and produces an additional resonance mode of the antenna. By an appropriate choice of its shape and its dimensions, it provides required values of the frequencies of the resonance modes, making it possible to associate two modes with crossed linear polarizations to transmit a circular polarization wave. The feed line terminates at a coupling device which is in the form of a microstrip line (see above) but which can also be regarded as a coplanar line because the microstrip is in the plane of the patch and penetrates between two notches in the patch. The device has impedance converter means for matching it to the various input impedances presented by the line at the various resonant frequencies used as operating frequencies.

This first prior art antenna has the following drawbacks:

The antenna being a half-wave antenna, its longitudinal dimension can be a problem if it is required to miniaturize the antenna.

The need to provide impedance converter means complicates its manufacture.

It is difficult to adjust the resonant frequencies precisely to required values.

A second prior art antenna is described in patent document U.S. Pat. No. 4,692,769 (Gegan). Its patch has a slot along a circular arc or a straight line segment inside the patch. The slot produces an additional resonance mode. The ends of the circular arc slot are enlarged to impart the same value to the antenna input impedance for the various operating frequencies. This second prior art antenna has the following drawbacks:

The above drawback relating to it being a half-wave antenna.

The polarizations of waves transmitted at the two resonant frequencies of the antenna are necessarily crossed polarizations, which can complicate the manufacture of certain telecommunication systems using the antenna.

A third prior art antenna is described in patent document U.S. Pat. No. 4,771,291 (LO et al.). Its patch includes slots along respective straight line segments within the patch. These slots reduce the difference between the two operating frequencies. Localized short-circuits also reduce this difference. They are provided by conductors passing through the substrate.

The third prior art antenna has the following drawbacks:

The above drawback relating to it being a half-wave antenna.

The incorporation of localized short-circuits complicates the manufacture of the antenna.

Likewise the feeding of the antenna via a coaxial line.

OBJECTS AND SUMMARY OF THE INVENTION

The present invention has the following aims in particular:

to limit the dimensions of a multifrequency antenna, to enable easy and precise adjustment of the operating frequencies of the antenna, and to enable the use of a single coupling device whose impedance can easily be tuned to more than one operating frequency.

With the above aims in view, the present invention consists in a multifrequency microstrip antenna comprising:

a plane dielectric substrate;

a conductor constituting a ground plane on the bottom surface of said substrate;

a plurality of conductive zones on the top surface of the substrate and each having an elongate shape imparting a candlestick shape to the antenna;

an antenna coupling device common to all the conductive zones;

and wherein said conductive zones are separated from each other by slots the widths of which are very much less than the operating wavelengths of the antenna;

wherein said conductive zones are sufficiently decoupled from each other to enable various resonances to occur, respectively, in various areas formed by said zones, said resonances being at least approximately of the quarter-wave type;

and wherein each of said zones has an electric field node fixed by at least one short-circuit to the ground plane and said short-circuit is in the vicinity of the base of the candlestick.

BRIEF DESCRIPTION OF THE DRAWINGS

Various aspects of the present invention are explained with the aid of the following description and the accompanying diagrammatic drawings. If the same item is shown in more than one of the figures it is designated by the same reference numerals and/or letters.

FIG. 1 is a perspective view of a communication device including a first antenna in accordance with the present invention.

FIG. 4 is a diagram showing the variation in a reflection coefficient at the input of the same antenna in decibels as a function of the frequency in MHz.

MORE DETAILED DESCRIPTION

Figure 2:
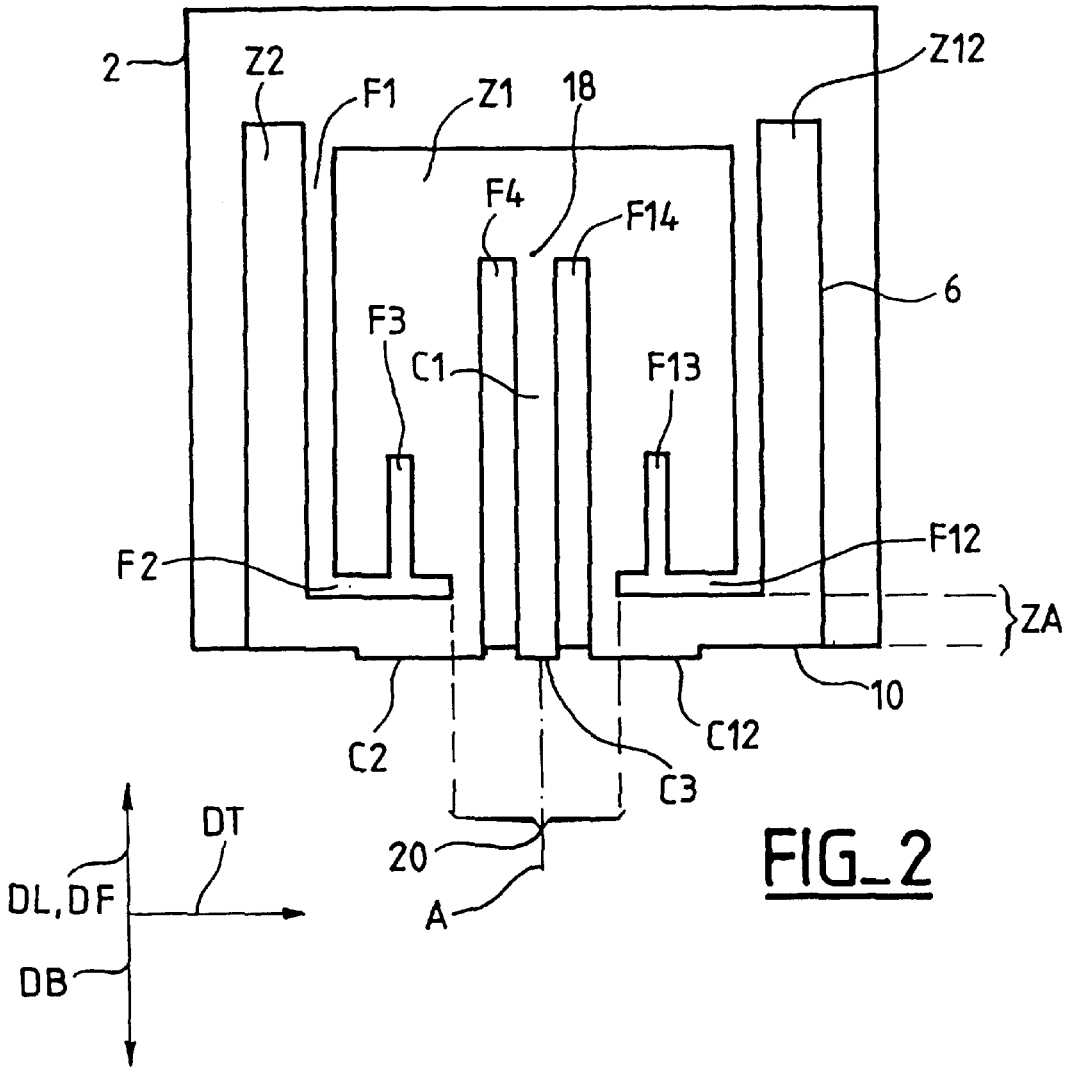
FIG. 2 is a top view of the antenna from FIG. 1.
Figure 3:
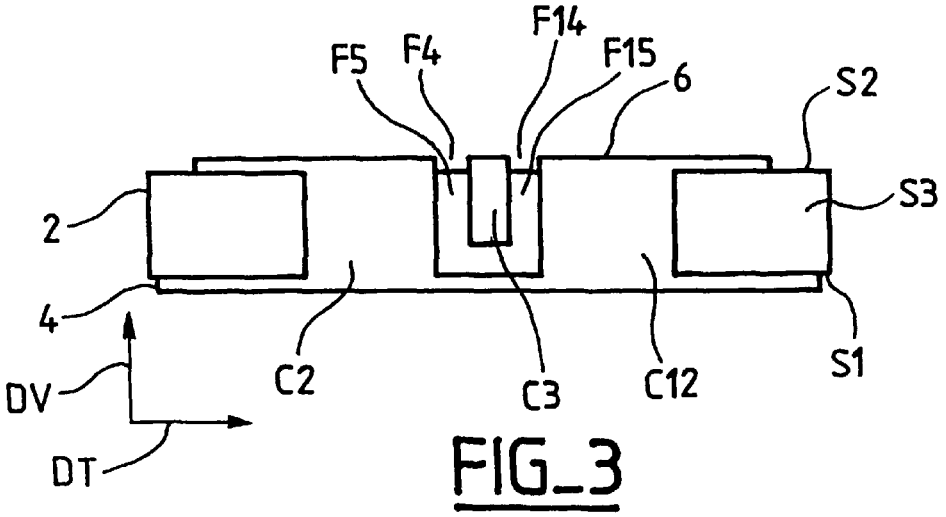
FIG. 3 is a front view of the same antenna.

A first antenna in accordance with the present invention has a resonant structure made up of the following components:

- A dielectric substrate 2 having two mutually opposed main surfaces extending in directions defined in the antenna and constituting horizontal directions DL and DT, these directions possibly depending on the area of the antenna concerned. As previously explained the substrate can have various shapes. Its two main surfaces are respectively a bottom surface S1 and a top surface S2. Another direction is also defined in the antenna. It is at an angle to each of the horizontal directions and constitutes a vertical direction DV. The angle just referred to is typically a right angle. However, the vertical direction can also be at different angles to the horizontal directions and can also depend on the area of the antenna concerned. The substrate has several edge surfaces, like the surface S3, each of which connects an edge of the bottom surface to a corresponding edge of the top surface and contains the vertical direction.
- A bottom conductive layer extending over the bottom surface and constituting an antenna ground 4.
- A top conductive layer extending over an area of the top surface above the ground 4 to constitute a patch 6. The patch has a configuration specific to the antenna. It also has a length and a width in two of said horizontal directions constituting a longitudinal direction DL and a transverse direction DT, respectively, the latter direction being parallel to the edge surface S3. Although the words length and width usually apply to two mutually perpendicular dimensions of a rectangular object, the length being greater than the width, it must be understood that the patch 6 can depart from that kind of shape without departing from the scope of the invention. In particular, the directions DL and DT can be at an angle other than 90 degrees, the edges of the patch need not be rectilinear and its length can be less than its width. One edge is at the intersection of the top surface S2 and the edge surface S3. It therefore extends in the transverse direction DT. It constitutes a rear edge 10 and defines one way DB in the longitudinal direction DL towards the rear edge and an opposite way DF towards the front. The configuration of the patch 6 forms at least one slot F1 within the patch. This slot produces at least one additional resonance in a group of resonances of the antenna. The group includes a plurality of resonances respectively corresponding to a plurality of operating modes and to a plurality of operating frequencies of the antenna. It can also include resonances that are not used.
- Finally, a short-circuit C2 electrically connecting the patch 6 to the ground 4. The short-circuit is formed in the edge surface S3 which is typically plane and which then constitutes a short-circuit plane. It imposes an at least approximately quarter-wave type antenna resonance.

The antenna further includes a coupling device in the form of a coupling line. The device includes a main conductor consisting of two sections C1 and C3 connected to the patch 6 at an internal connection point 18. It further includes a composite ground conductor that co-operates with the main conductor and is described below. It constitutes all or part of a connection system that connects the resonant structure of the antenna to a signal processing unit 8, for example to excite one or more antenna resonances from that unit in the case of a transmit antenna. In addition to this device the connection system typically includes a connection line C4, C5 external to the antenna and including two conductors. At an antenna end of this line the two conductors are connected to respective connecting conductors that are part of the coupling device and which can be considered to form two terminals of the antenna. At the other end of the line its two conductors are respectively connected to two terminals of the signal processing unit. The line can be of the coaxial type, of the microstrip type or of the coplanar type. If the antenna concerned is a receive antenna, the same system transmits the signals received by the antenna to the signal processing unit. The various components of the system have the functions previously defined.

The signal processing unit is adapted to operate at the resonant frequencies that constitute said operating frequencies of the antenna. It can be a composite unit in which case it includes a component tuned permanently to each operating frequency. It can equally include a tunable component.

The present invention also consists in a communication device including an antenna in accordance with the present invention and a signal processing unit of the above kind connected to the antenna by a connection system of the above kind.

The antenna of the example is a dual-frequency antenna, i.e. it must give rise to at least two resonances so that it can operate in two modes corresponding to two operating frequencies. To this end a slot formed in the patch 6 opens towards the front and outside the patch. It constitutes a longitudinal separator slot F1. The longitudinal extent of this slot defines in the patch a front region Z2, Z1, Z12 in which the slot divides a primary zone Z1 from a secondary zone Z2. A rear region ZA extends between the front region and the rear edge 10. The rear region is preferably shorter and even more preferably much shorter in the longitudinal direction DL than the front region.

The internal connection point 18 is outside the secondary zone and is preferably in the primary zone Z1. One operating mode of the antenna then constitutes a primary mode in which a standing wave is established by virtue of propagation of traveling waves both ways in the longitudinal direction or a direction near the longitudinal direction, the waves propagating in an area including the primary zone and the rear region and substantially excluding the secondary zone Z2. Another operating mode constitutes a secondary mode in which a standing wave is established by virtue of propagation of traveling waves both ways (the same as before) in another area including the primary and secondary zones and the rear region.

In the context of this arrangement the rear region ZA has a first function of coupling the secondary zone to the primary zone to enable the secondary mode to be established. It has a second function of enabling the short-circuit on the rear edge to exercise its role in each of these two zones. The antenna is then a quarter-wave antenna, at least approximately, for each operating frequency.

The configurations of the patch and of the coupling line and more particularly the longitudinal position of the internal connection point 18 are chosen to obtain a required predetermined value of the impedance presented by the antenna to the signal processing unit or more typically of a connecting line connecting that unit to the device. This impedance is referred to as the antenna impedance hereinafter. In the case of a transmit antenna it is usually called the input impedance. Its required value is advantageously equal to the impedance of the connecting line. This is why the position of the connection point preferably gives substantially the same antenna impedance value for the various operating frequencies.

It is generally beneficial for the operating frequencies to have predetermined required values. These values can advantageously be obtained by an appropriate choice of the respective longitudinal dimensions of the primary zone Z1 and the secondary zone Z2. This is why, in the context of the present invention, these two dimensions are typically different. As a result the front edge of the patch necessarily departs from a transverse straight line.

In the case more particularly described here the configuration of the patch 16 preferably also forms a slot extending in the transverse direction DT. This slot constitutes a transverse separator slot F2 partly separating the primary zone from the rear region ZA. It is preferably connected to the rear end of the longitudinal separator slot F1.

The configuration of the patch 6 advantageously forms at least one slot F3 in the primary zone Z1 in the longitudinal direction DL. This slot preferably extends towards the front from the transverse separator slot F2. It might be called the frequency reducing slot because its role is to reduce the operating frequencies as its length increases. Thus it not only limits the length of the patch necessary to obtain predetermined required values of the operating frequencies but also enables those frequencies to be adjusted by appropriately adjusting its length.

The antenna preferably has a plane of symmetry extending in the longitudinal directional DL and the vertical direction DV, the trace of this plane in the top surface of the substrate constituting an axis of symmetry A of the patch 6. If two components are symmetrical to each other about the axis or plane of symmetry the number included in the reference symbols for that on the right in the figures is equal to the corresponding number for that on the left increased by 10. The coupling device and the primary zone Z1 extend to the vicinity of the axis A and the configuration of the patch forms said two longitudinal separator slots F1, F11 on respective opposite sides of the primary zone. The secondary zone then includes two parts Z2, Z12 beyond the respective slot.

Given the above, the set of separator slots F1, F2, F11, F12 is U-shaped. The branches and the base of the U are respectively longitudinal and transverse. The base has an axial gap 20 extending either side of the axis for connecting the primary zone Z1 to the short-circuit C2, C12 by means of an axial part of the rear region ZA.

In an advantageous arrangement the coupling line that constitutes the coupling device of the antenna includes a conductor that is part of the top conductive layer. To be more precise, a section C1 of said main conductor enters the area of the patch 6 in the longitudinal direction DL. It extends between a rear end near the rear edge 10 and a front end consisting of the internal connection point 18. This main conductor section is in the form of a strip and might be called the horizontal coupling strip. As known in itself the strip is limited laterally by two notches. However, in the antenna of the present invention the two notches are sufficiently narrow in the direction DT and sufficiently long in the direction DL to be respectively regarded as two longitudinal slots F4 and F14. The two slots separate the strip from the patch 6 and are referred to as coupling slots hereinafter. Their width allows for the fact that the parameters of the line of which the coupling strip constitutes the main conductor can advantageously be determined in designing the line as a coplanar line adapted to excite the antenna in a distributed fashion along the length of the line rather than as a microstrip line adapted to excite the antenna only at the end of the line, the ground conductor of the coplanar line then consisting primarily, like a coplanar line, of the parts of the patch on respective opposite lateral sides of the strip beyond the two slots F4 and E14 and not of the antenna ground as in a microstrip line. This line is referred to hereinafter as the horizontal coplanar line.

It would enable the antenna to be coupled by means of an electromagnetic signal applied to or picked up by the external connection line at the rear end of the horizontal coplanar line between two terminals common to the horizontal coplanar line and the antenna, the two terminals respectively comprising the ground conductor of the line and the rear end of the strip. However, at least in the case of devices such as certain mobile telephones, making the connection between the coupling device and the external line by means of conductors of this kind in the plane of the patch would complicate the manufacture of the device.

In particular, the horizontal coplanar line in question extends along the axis A. It enters the axial gap 20 at the base of the U, this gap being delimited by the two coupling slots E4 and E14. As previously mentioned, the position of the front end 18 of its main conductor is determined to obtain a required value of the antenna impedance. However, the antenna impedance depends also on other parameters such as the widths of the coupling strip C1 and of the coupling slots and on the nature of the substrate.

In accordance with another advantageous feature, said short-circuit is a composite short-circuit comprising two short-circuit conductors C2 and C12. The two conductors extend in the vertical direction DV with a gap between them. Each of them connects the antenna ground 4 to the patch 6.

The antenna coupling line further includes connecting conductors that are formed on the edge surface S3 and which can form a vertical coplanar line. A line of this kind is more particularly made up of the following conductors:

- A main conductor C3 extending in the vertical direction DV between a bottom end and a top end in the gap left between the two short-circuit conductors. The top end is connected to the rear end of the main conductor C1 of the horizontal coplanar line. The main conductor of the vertical coplanar line simultaneously constitutes said first connecting conductor, a first terminal of the antenna and a vertical section of the main conductor of the coupling line.
- Two ground conductors co-operating with the conductor C3 and consisting of the two short-circuit conductors C2 and C12. The two short-circuit conductors also together constitute a second terminal of the antenna.

In the case of a device with limited dimensions, the fact that the connecting conductors are formed on the edge surface S3 significantly facilitates making a connection between the coupling device which is part of the antenna formed on the surface of the device and a connecting line connecting the device to a signal processing unit. If the unit is inside the device the line can take the form of a coaxial line which in the vicinity of the antenna is perpendicular to the plane of the antenna. In other cases this arrangement of the connecting conductors facilitates connecting the antenna to conductors carried by a mother board to one face of which the substrate of the antenna has previously been fixed, the connecting line typically then being parallel to the longitudinal direction of the antenna, at least in the vicinity of the antenna. Forming connecting conductors of this kind adapted to form terminals of the antenna on the edge surface of the substrate complicates the manufacture of the antenna to only a negligible degree. The short-circuit conductors are required for the antenna as manufactured to be of the quarter-wave type. The first connecting conductor can be formed by a process at least similar to that used for the short-circuit conductors and in most cases during the same fabrication step.

More particularly, in an advantageous arrangement specific to the first example antenna all the connectors of the coupling device are made collectively by the following steps:

forming a vertical conductive layer on the edge surface S3, and etching this layer to form the two short-circuit conductors C2 and C12 and the first connecting conductor C3 simultaneously. The conductors then constitute two short-circuit strips and a vertical coupling strip, respectively.

The connecting conductors preferably occupy only a fraction of the rear edge 10. In the example antenna this is substantially the same fraction as the primary zone Z1.

The widths of the coupling strips and the slots such as the coupling slots on respective opposite sides of the strips are preferably chosen to obtain a uniform and suitable impedance, which is typically 50 ohms, for the coupling line consisting of the vertical and horizontal coplanar lines. The antenna impedance is adjusted by choosing the position of the internal connection point 18.

In the embodiment described by way of example the connecting line external to the antenna is a coaxial line. It includes an axial conductor C4. At a first end of the line the axial conductor is connected to the conductor C3. At the other end of the line it is connected to a first terminal of the signal processing unit 8. Along the length of the line it is surrounded by a conductive sheath C5. At the first end of the line the sheath is connected to both short-circuit conductors C2 and C12. At the other end of the line it is connected to the other terminal of the signal processing unit 8, which is a transmitter, for example.

In the context of one embodiment of the first antenna, various compositions and values are given below by way of numerical example. The lengths and widths are respectively indicated in the longitudinal direction DL and the transverse direction DT.

primary operating frequency: 940 MHz, secondary operating frequency: 870 MHz, input impedance: 50 ohms, composition and thickness of substrate: epoxy resin having a relative permittivity $e_r$=4.3 and a dissipation factor tan d=0.02, thickness 1.6 mm, composition and thickness of conductive layers: copper, 17 microns, length of primary zone Z1: 26 mm, width of zone Z1: 29 mm, length of secondary zones Z2 and Z12: 30 mm, width of each of these zones: 5.5 mm, length of rear region Z3: 2.5 mm, length of conductor C1 of horizontal coplanar line: 25 mm, width of conductor C1 and main conductor C3 of vertical coplanar line: 2.1 mm, height of conductor C3: 0.8 mm, common width of all slots, in horizontal direction for transverse slots F2 and F12: 0.5 mm, length of frequency reducing slots F3 and F13: 5 mm, width of axial gap 20: 7 mm, width of each short-circuit conductor C2 and C12: 5 mm.

Figure 5:
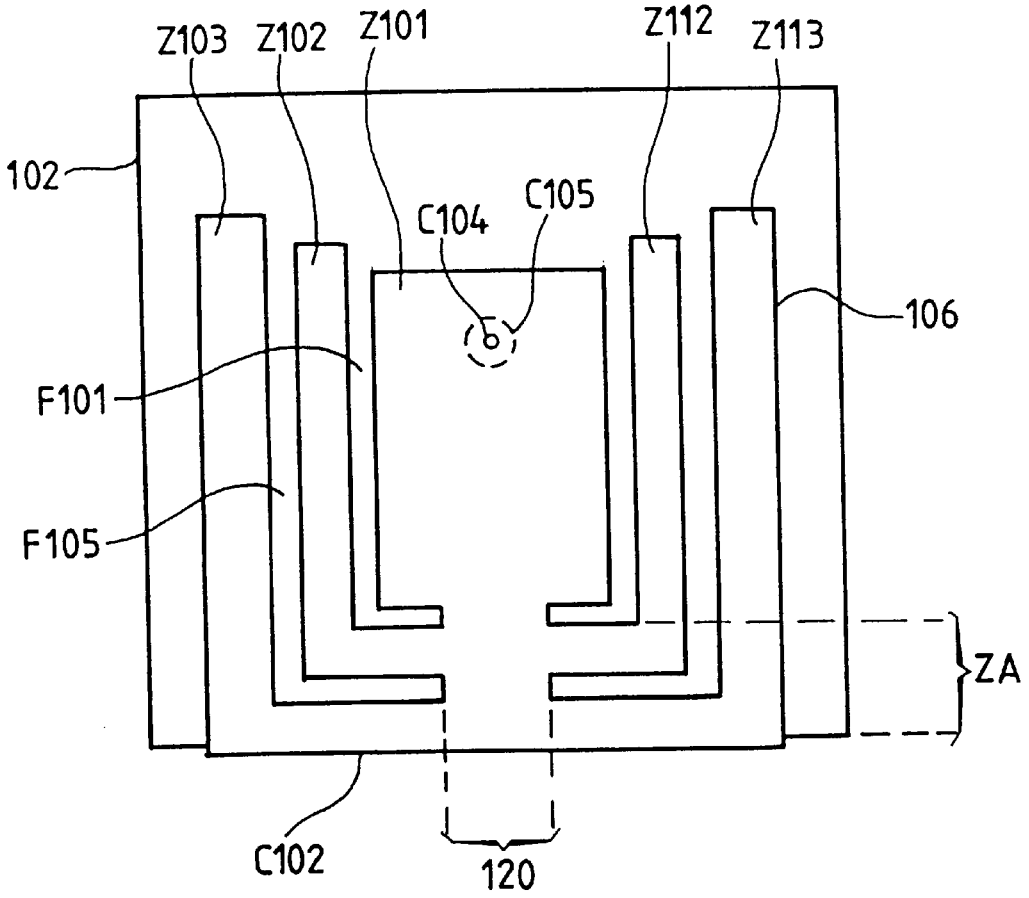
FIG. 5 is a top view of a second antenna in accordance with the present invention.

FIG. 5 shows the second embodiment of an antenna in accordance with the present invention which is generally similar to the first antenna previously described. If a component of the second antenna has the same functions as a component of the first antenna it is designated by the same reference letters and/or numerals but with the numerals increased by 100. For example, the primary zone Z101 of the second antenna is analogous to the primary zone Z1 of the first antenna. The second antenna differs from the first antenna in the following respects:

First of all, it caters for the fact that three operating frequencies are needed. The patch 106 therefore additionally includes two mutually symmetrical tertiary zones. A first U-shaped slot F101 partly separates the primary zone Z101 from the two secondary zones Z102 and Z112. It lies within a second slot F105 the same shape separating the secondary zones from the tertiary zones Z103 and Z113.

The short-circuit is a single conductor C102 extending the full width of the patch 106 and the coupling between the primary, secondary and tertiary zones is effected in the rear zone ZA by the axial gap 120. Finally, the antenna is coupled to a vertical coaxial line. A terminal section of the axial conductor C104 of that line passes through the substrate 102 and is welded to the patch 106 in the primary area Z101. It therefore constitutes the antenna coupling device. The conductive sheath C105 of the line is welded to the antenna ground (not shown) consisting of a continuous conductive layer covering the bottom surface of the substrate 102. The part of the coaxial line below the antenna constitutes its connecting line.

It must be understood that the number of operating frequencies of an antenna in accordance with the invention can be greater than three, the patch of an antenna of that kind then including, in the case of four frequencies, a primary zone, two secondary zones, two tertiary zones and two quaternary zones.

Also, the configurations of the patch and of the short-circuit are not necessarily symmetrical.

What is claimed is:

1. A multifrequency microstrip antenna including:

a plane dielectric substrate;

a conductor constituting a ground plane on the bottom surface of said substrate;

a plurality of conductive zones on the top surface of the substrate and each having an elongate shape imparting a candlestick shape to the antenna;

an antenna coupling device common to all the conductive zones;

and wherein said conductive zones are separated from each other by slots the widths of which are very much less than the operating wavelengths of the antenna;

wherein said conductive zones are sufficiently decoupled from each other to enable various resonances to occur, respectively, in various areas formed by said zones, said resonances being at least approximately of the quarter-wave type;

and wherein each of said zones has an electric field node fixed by at least one short-circuit to the ground plane and said short-circuit is in the vicinity of the base of the candlestick.

2. A multifrequency microstrip antenna including:

a dielectric substrate having two mutually opposed main surfaces extending in directions defined in said antenna and constituting horizontal directions, said two surfaces respectively constituting a bottom surface and a top surface, another direction being further defined in said antenna at an angle to each of said horizontal directions, said other direction constituting a vertical direction, a bottom conductive layer on said bottom surface and constituting a ground of said antenna, a top conductive layer on an area of said top surface above said ground having a plurality of conductive zones, to constitute a patch having a configuration, a length and a width, said length and said width being in two of said horizontal directions constituting a longitudinal direction and a transverse direction, respectively, said configuration forming at least one slot within said patch, said slot contributing to defining for said antenna a group of resonances including a plurality of resonances respectively corresponding to a plurality of operating modes and to a plurality of operating frequencies of said antenna, and an antenna coupling device including:

a main conductor connected to said patch at a connecting point, and a ground conductor, so that said antenna can be connected to a signal processing unit via said device for each of said operating frequencies, wherein said conductive zones are separated from each other by slots the widths of which are very much less than the operating wavelengths of the antenna;

wherein said conductive zones are sufficiently decoupled from each other to enable various resonances to occur, respectively, in various areas formed by said zones, said resonances being at least approximately of the quarter-wave type;

wherein each of said zones has an electric field node fixed by at least one short-circuit to the ground plane; and wherein said at least one short-circuit electrically connects said patch to said ground at an edge of said patch, said edge extending in said transverse direction and constituting a rear edge defining in said patch in said longitudinal direction a rearward way directed towards said rear edge and an opposite forward way directed towards the front, two regions of said patch respectively constituting a rear region contiguous with said rear edge and a front region in front of said rear region, one slot opening towards the front and outside said patch to constitute a longitudinal separator slot dividing said front region into two of said zones respectively constituting a primary zone and a secondary zone, said connecting point being outside said secondary zone.

3. An antenna according to claim 2, wherein said rear region is shorter in said longitudinal direction than said front region.

4. An antenna according to claim 3, wherein said connecting point is in said primary zone, one of said operating modes constituting a primary mode in which a stationary wave is established by virtue of propagation of traveling waves both ways in a direction at least close said longitudinal direction, said waves propagating in one of said areas including said primary zone and said rear region, substantially to the exclusion of said secondary zone, another of said operating modes constituting a secondary mode in which a standing wave is established by virtue of propagation of traveling waves the same two ways, said waves propagating in another of said areas including said primary and secondary zones and said rear region.

5. An antenna according to claim 2, wherein the position of said connecting point gives said antenna substantially the same impedance for the various operating frequencies.

6. An antenna according to claim 2, wherein said primary zone and said secondary zone have different respective dimensions in said longitudinal direction.

7. An antenna according to claim 4, wherein said short-circuit is formed only on a segment of said rear edge, the position of said segment in the width of said patch being closer to that of said primary zone than that of said secondary zone, said segment constituting a short-circuit segment, said configuration of said patch further forming one of said slots extending in said transverse direction and constituting a transverse separator slot partly separating said primary zone from said rear region.

8. An antenna according to claim 2, wherein said configuration of the patch further forms at least one slot extending in said longitudinal direction in said primary zone.

9. An antenna according to claim 2, having a plane of symmetry in said longitudinal direction and said vertical direction, the trace of said plane in said top surface of the substrate constituting an axis of symmetry for said patch, said coupling device and said primary zone being in the vicinity of said axis, said configuration of the patch forming two of said longitudinal separator slots on respective opposite sides of said primary zone, said secondary zone having two parts beyond the respective slots.

10. A radio communication device including an antenna according to claim 2 and a signal processing unit connected to said antenna and adapted to operate at said operating frequencies.

* * * * *